United States Patent [19]

Ishii et al.

[11] Patent Number: 4,620,517

[45] Date of Patent: Nov. 4, 1986

[54] ENGINE SPEED CONTROL APPARATUS

[75] Inventors: Mitsuaki Ishii; Masaaki Miyazaki, both of Himeji; Noboru Nakamura; Hideo Kakinuma, both of Kyoto, all of Japan

[73] Assignees: Mitsubishi Denki Kabushiki Kaisha; Mitsubishi Jidosha Kogyo Kabushiki Kaisha, both of Tokyo, Japan

[21] Appl. No.: 585,154

[22] PCT Filed: Jun. 30, 1983

[86] PCT No.: PCT/JP83/00207

§ 371 Date: Feb. 22, 1984

§ 102(e) Date: Feb. 22, 1984

[30] Foreign Application Priority Data

Jul. 2, 1982 [JP] Japan ..... 57-115957
Jul. 2, 1982 [JP] Japan ..... 57-115958

[51] Int. Cl.[4] ..... F02D 11/10
[52] U.S. Cl. ..... 123/339
[58] Field of Search ..... 123/339

[56] References Cited

U.S. PATENT DOCUMENTS

| | | | |
|---|---|---|---|
| 4,391,244 | 7/1983 | Kobashi | 123/339 |
| 4,453,518 | 6/1984 | Nakamura | 123/339 |
| 4,484,552 | 11/1984 | Kobayashi | 123/339 |
| 4,484,554 | 11/1984 | Nakajima | 123/339 |
| 4,524,738 | 6/1985 | Chastagner | 123/339 |
| 4,524,739 | 6/1985 | Kashiwaya | 123/339 |

*Primary Examiner*—Ronald B. Cox
*Attorney, Agent, or Firm*—Bernard, Rothwell & Brown

[57] ABSTRACT

An apparatus for controlling an engine speed through intermittent control of a driving time and a halt time for an engine-speed adjusting actuator (12) in accordance with the output signal of a difference detecting circuit (6) corresponding to the difference between the outputs of a desired speed computing circuit (5) and an actual speed computing circuit (4). The feature of the invention resides particularly in determining the actuator halt time in proportion to the desired quantity of control for the actuator (12) or the engine operation parameter without limiting the said time to any fixed length, hence eliminating overshoot of the engine speed in the control and ensuring satisfactory apparatus capabilities with a short halt time and enhanced response characteristic.

8 Claims, 7 Drawing Figures

ENGINE SPEED CONTROL APPARATUS

TECHNICAL FIELD

The present invention relates to an apparatus for controlling the rotational speed of an engine through intermittent control of an actuator serving to adjust the engine speed.

BACKGROUND ART

In the automobile engine, it is generally customary to lower the idling speed thereof for attaining an improved fuel economy as well as reducing the amount of exhaust gas. However, considering the variation in engine capabilities and the subsequent secular change induced therein, a certain limit is existent in lowering the idling speed. Under such circumstances, it is the latest trend to employ an electronic control apparatus which is capable of achieving accurate and stable control of the idling speed continuously for a long time.

FIG. 1 is a block diagram of an exemplary conventional apparatus used for control of an idling speed by changing the stopper position of a throttle valve with employment of a DC motor. The apparatus shown comprises an ignition coil 1, an ignition coil controller 2, a period measuring circuit 3, an actual speed computing circuit 4 (second unit), a desired speed computing circuit 5 (first unit), a load switch 51 for an air conditioner or the like, a cooling water temperature sensor 52, a difference detecting circuit 6 (third unit), a control pulse width computing circuit 7 (fourth unit), a pulse width counter 8, a control period counter 9, a control signal generating circuit 10 (fifth, unit), a driving circuit 11 (sixth unit), a throttle valve actuator 12, a throttle valve 13, and an accelerator pedal 14. The throttle valve actuator 12 comprises a DC motor 121, a reduction mechanism 122 for converting the rotary motion of the DC motor 121 into a linear motion, an idle switch 123 for detecting the fully closed position of the accelerator pedal 14, a throttle stopper 124 moved linearly by the reduction mechanism 122, and a cam mechanism 125 interlocked with the throttle valve 13.

In the conventional apparatus mentioned above, the following operation is performed. Period measuring circuit 3 is connected to ignition coil 1 so as to measure the time interval between ignition signals. Actual speed computing circuit 4 converts the output of period measuring circuit 3, which represents the time interval between ignition signals, into a speed signal of a weight corresponding to the actual rotational speed. Desired speed computing circuit 5 computes a desired idling speed and feeds the result to difference detecting circuit 6. Then the circuit 6 compares the output of actual speed computing circuit 4 with the output of desired speed computing circuit 5 and feeds the difference therebetween as a rotational speed difference signal to control pulse width computing circuit 7 while outputting a signal, which represents the numerical relationship between the output values of computing circuits 4 and 5, to both control pulse width computing circuit 7 and control signal generating circuit 10. Control pulse width computing circuit 7 computes an optimal time for driving DC motor 121 in accordance with the aforesaid two signals and feeds the result to pulse width counter 8. FIG. 2 graphically shows the relationship between the rotational speed difference signal and the DC motor driving time, wherein the speed difference is plotted along the abscissa while the driving time is plotted along the ordinate. Since the driving time is zero within a range where the speed difference is less than a dead zone speed Nd, DC motor 121 is not driven so that the position of throttle stopper 124 remains unchanged. The right side from the zero point of the speed difference corresponds to a range where the actual engine speed is lower than the desired idling speed, representing the relationship between the speed difference and the driving time in the case of opening throttle valve 13 by rotating DC motor 121 in its forward direction and shifting cam mechanism 125 via throttle stopper 124. To the contrary, the left side from the zero point of the speed difference corresponds to a range where the actual engine speed is higher than the desired idling speed, representing the relationship between the speed difference and the driving time in the case of closing throttle valve 13 by rotating DC motor 121 in its reverse direction.

In the meanwhile, control period counter 9 serves to count the period for intermittently driving DC motor 121 and feeds an output signal to pulse width counter 8 per predetermined period (T) shown in FIG. 3. Pulse width counter 8 is of a preset type which functions to preset the output value of control pulse width computing circuit 7 in response to the output signal of control period counter 9 and simultaneously starts subtractive count per fixed time. Pulse width counter 8 continues such subtractive count until reduction of its content to zero and then feeds an output signal to control signal generating circuit 10. This circuit 10 judges from the output signal of difference detecting circuit 6 the numerical relationship between the desired idling speed and the actual engine speed and, when the latter speed is lower than the former speed, introduces the output signal of pulse width counter 8 as a forward rotation signal to the output terminal 101. To the contrary, when the actual engine speed is higher than the desired idling speed, the circuit 10 introduces the output signal of pulse width counter 8 as a reverse rotation signal to the output terminal 102. However, merely in the on-state of idle switch 123 where the accelerator pedal 14 is placed at the fully closed position thereof, control signal generating circuit 10 feeds its signal to the output terminal 101 or 102 to execute the idling speed control. Driving circuit 11 rotates DC motor 121 in the forward direction during the presence of the output signal at terminal 101, whereby throttle stopper 124 is pushed out to open throttle valve 13, hence raising the engine speed. To the contrary, DC motor 121 is rotated in the reverse direction during the presence of the output signal at terminal 102, so that throttle stopper 124 is withdrawn to close throttle valve 13 and thereby lowers the engine speed.

An exemplary operation performed until stabilization of the engine speed will now be described with reference to FIG. 3, which shows the state where accelerator pedal 14 is placed at its fully closed position and the engine load has been increased prior to time t1 to render the engine speed N lower than the desired idling speed $N_0$. The engine speed is $N_1$ at time t1, and the output value of control pulse width computing circuit 7 is TP1 in FIG. 2. Accordingly, pulse width counter 8 produces an output signal during time length TPl posterior to time t1. Since the current engine speed N is lower than the desired idling speed $N_0$, the output of pulse width counter 8 is introduced to the output terminal 101 of control signal generating circuit 10 as shown in FIG. 3 (*a*), so that driving circuit 11 rotates DC motor 121 in its forward direction during time length TP1, thereby pushing out throttle stopper 124. As a result, throttle valve 13 is opened to raise the engine speed. In the next stage where the engine speed reaches N2 at time t2 after the lapse of a predetermined period T from time t1, the engine speed N2 is still lower than the desired idling speed $N_0$, so that DC motor 121 is further rotated in its forward direction during time length TP2 as in the preceding stage. Consequently, the engine speed N is so raised that the difference between N and $N_0$ becomes smaller than the dead zone speed Nd prior to arrival at time t3, and therefore the signal for driving DC motor 121 is no longer outputted at time t3. Thereafter, DC motor 121 is not driven until the speed difference exceeds the dead zone speed Nd due to some external disturbance. Thus, it becomes possible to maintain the engine speed N at the desired idling speed $N_0$ by intermittently driving DC motor 121 under control in the manner described.

For attaining enhanced response characteristic in the conventional apparatus mentioned above, it is necessary to shorten the period of intermittent control. However, shortening the period brings about a problem which will be explained below with reference to FIG. 4. When the engine speed is N3 at time t3 with accelerator pedal 14 placed at its fully closed position, DC motor 121 is rotated in the forward direction during time length TP3 to increase the engine speed. Meanwhile, since period T1 is set to be shorter than period T shown in FIG. 3, the engine speed is not rendered stable even at time t4 after the lapse of period T1 and is thereby kept varying continuously. Supposing that the control is interrupted posterior to time t4, the engine speed is successively increased for a while even after time t4 and then is stabilized as shown by a dotted line A in FIG. 4. However, since time length TP4 for driving the DC motor 121 is determined on the basis of the difference between the engine speed N4 and the desired idling speed $N_0$ at time t4, it follows that throttle valve 18 is opened excessively by a value corresponding to the increase shown by the dotted line A in FIG. 4, thereby causing overshoot of the engine speed N as shown in FIG. 4 (*c*) to consequently induce an unsatisfactory result with respect to the control. In order to prevent occurrence of such a phenomenon, it is necessary to select a proper intermittent control period which causes no overshoot of the engine speed N even with the maximal driving time length $TP_{MAX}$ allowable for the control. But the period selected in this manner becomes unduly long to deteriorate the response characteristic eventually. Thus, a problem has been existent heretofore with regard to extreme difficulties in achieving satisfactory compatibility of the control and response characteristics.

DISCLOSURE OF THE INVENTION

An improved engine speed control apparatus is accomplished according to the present invention, wherein an actuator for adjusting an engine speed is controlled intermittently in such a manner that a time length for driving the actuator is determined in conformity with the difference between a desired engine speed and a detected value while a halt time length for interrupting the driving of the actuator is altered in accordance with an engine operation parameter or the said driving time length, thereby eliminating overshoot of the engine speed in the control and shortening the driving halt time length to attain enhanced response characteristic.

BEST MODE FOR CARRYING OUT THE INVENTION

Figure 1:
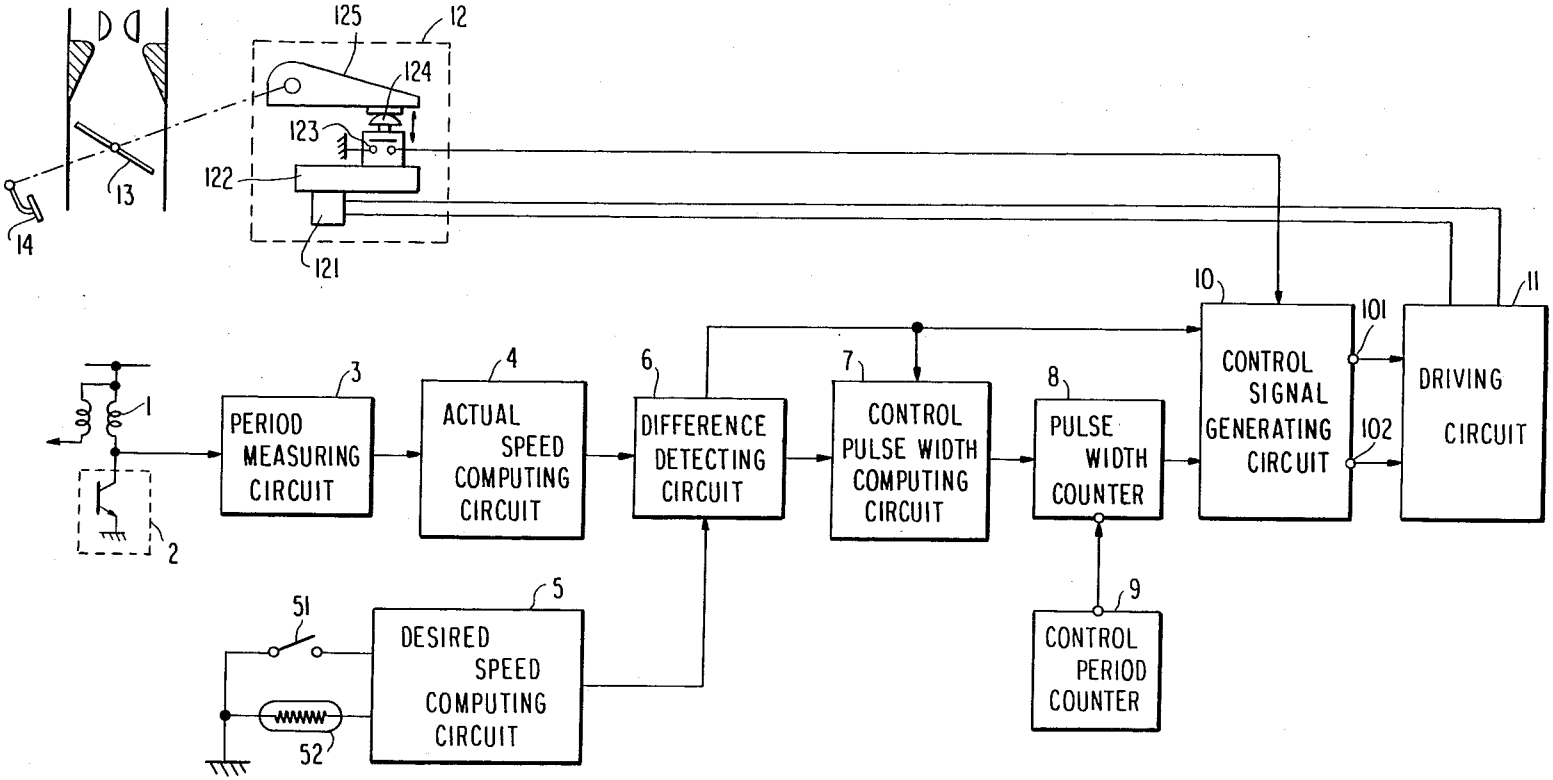
FIG. 1 is a block diagram of a conventional apparatus.
Figure 2:
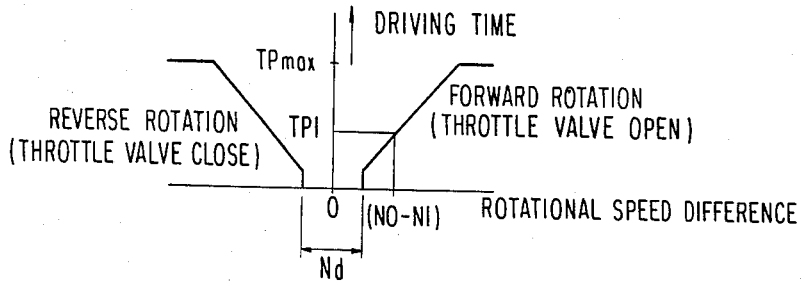
FIG. 2 graphically shows the characteristics of a control pulse width computing circuit.
Figure 3:
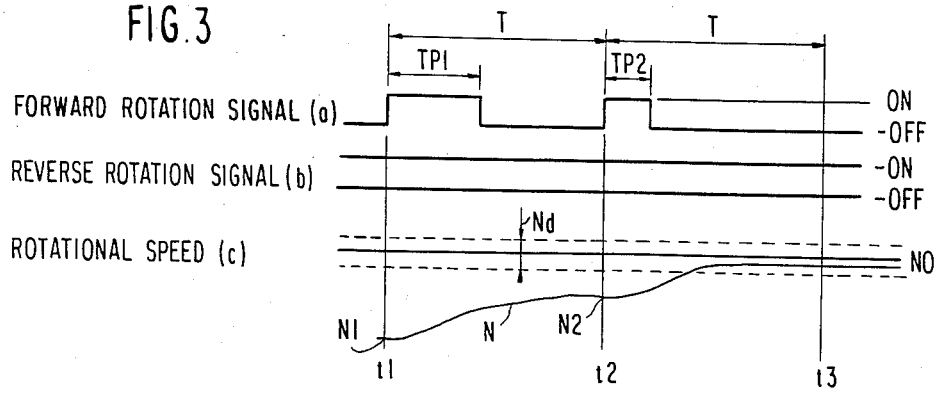
FIGS. 3 and 4 are timing charts of an operation in the conventional apparatus.
Figure 5:
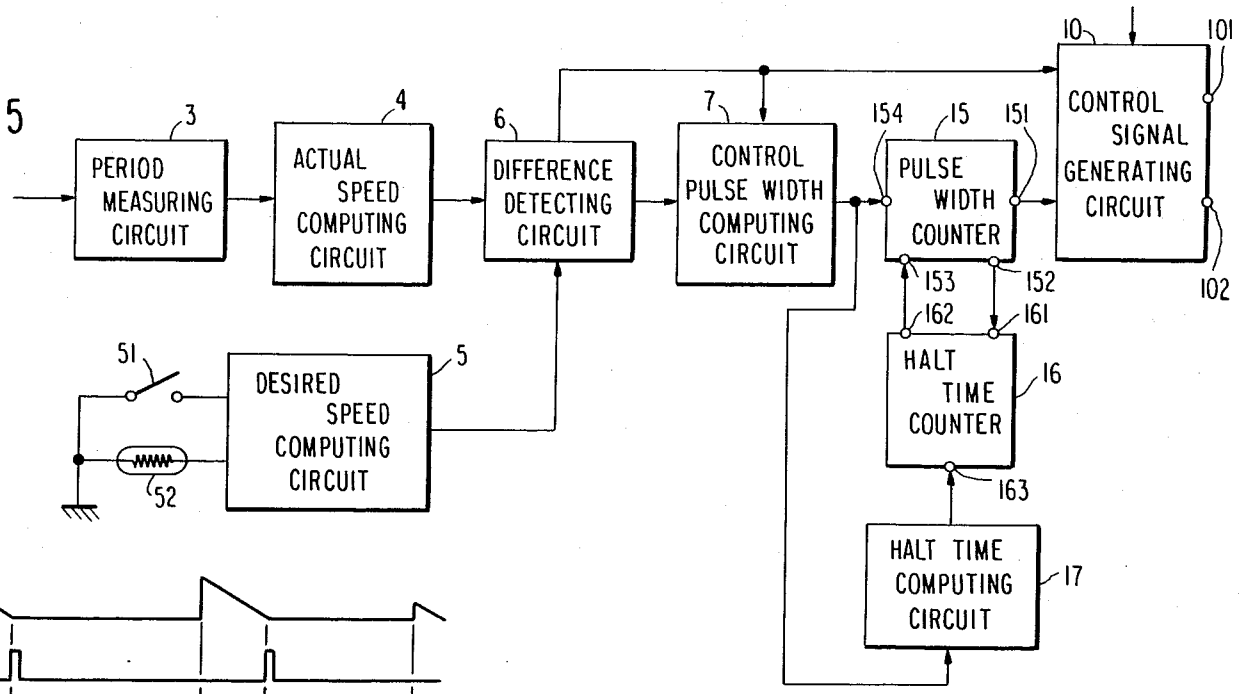
FIG. 5 is a block diagram of an exemplary apparatus embodying the present invention.
Figure 6:
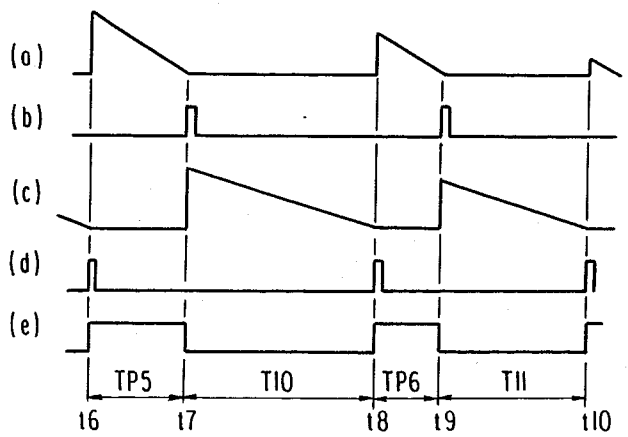
FIG. 6 is a timing chart of an operation in the apparatus of FIG. 5.

In the block diagram of FIG. 5 showing an exemplary embodiment of the present invention, there are provided a pulse width counter 15, output terminals 151 and 152, input terminals 153 and 154, a halt time counter 16, input terminals 161 and 163, an output terminal 162, and a halt time computing circuit 17 (seventh unit). Other components such as an ignition coil 1, an ignition coil controller 2, a driving circuit 11 and a throttle valve actuator 12 are the same as those shown previously in FIG. 1 and are therefore omitted in the diagram of FIG. 5. FIG. 6 is a timing chart for explaining the operation performed in the apparatus of FIG. 5, wherein there are shown a counted value (a) of pulse width counter 15, an output signal (b) obtained at output terminal 152, a counted value (c) of halt time counter 16, an output signal (d) obtained at output terminal 162, and an output signal (e) obtained at output terminal 151.

Hereinafter the operation in the apparatus of FIG. 5 will be described with reference to FIG. 6 which graphically shows a state where the engine speed is under control with the speed difference exceeding a dead zone. A period measuring circuit 3, an actual speed computing circuit 4, a desired speed computing circuit 5, a difference detecting circuit 6 and a control pulse width computing circuit 7 shown in FIG. 5 function in the same manner as those shown in FIG. 1. Meanwhile the pulse width counter 15 and the halt time counter 16 are of a preset type, so that the data being fed to input terminal 154 is preset in pulse width counter 15 upon application of a signal to input terminal 153 of pulse width counter 15. Subsequently, this counter 15 continues subtractive count for a predetermined time length as shown in FIG. 6 (*a*) and produces a pulse signal of FIG. 6 (*b*) from output terminal 152 upon termination of the subtractive count when the counted value reaches zero. Pulse width counter 15 further produces another signal of FIG. 6 (*e*) from output terminal 151 during its subtractive count to determine the time length for driving DC motor 121. In response to the signal of FIG. 6 (*b*) fed to input terminal 161, halt time counter 16 presets the output data of halt time computing circuit 17 being applied to input terminal 163 and then continues subtractive count for a predetermined time length as shown in FIG. 6 (*c*). And upon arrival of the counted value at zero, halt time counter 16 terminates its subtractive count and produces a pulse signal of FIG. 6 (*d*) from output terminal 162. The pulse signal thus produced is fed to input terminal 153, thereby presetting in pulse width counter 15 the output data of control pulse width computing circuit 7 obtained when the counted value of halt time counter 16 reaches zero. In the following stage, the preceding operation is repeated to proceed with the control until the rotational speed difference is reduced to be less than the dead zone speed.

Figure 4:
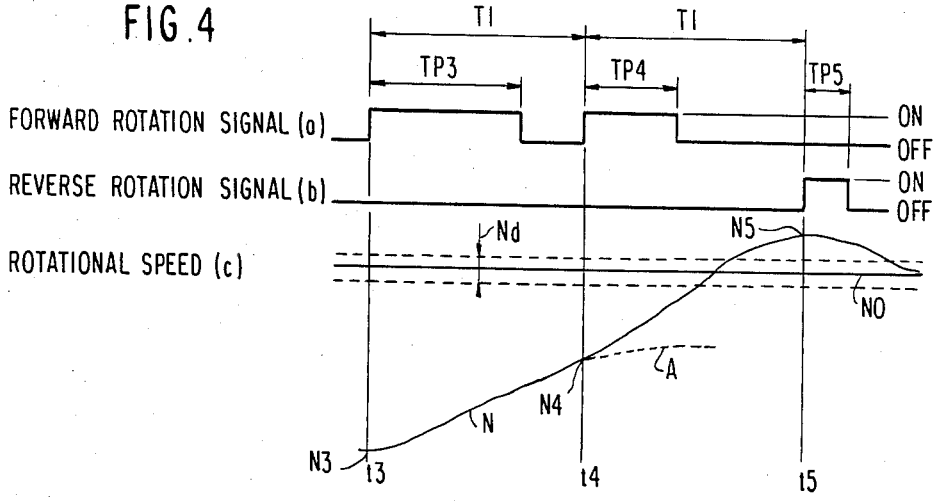

Halt time computing circuit 17 is so arranged as to send the time length data, which is proportional to the control pulse width outputted from control pulse width computing circuit 7, to the input terminal of halt time counter 16. In case the driving time for DC motor 121 is relatively approximate to the engine response time, the time length required for stabilizing the engine speed at its steady value after an interruption tends to increase as the driving time becomes longer. Therefore, by previously adjusting the halt time computing circuit 17 in such a manner as to output an optimal halt time proportional to the driving time, it is rendered possible to obtain the shortest halt time in relation to any driving time, hence achieving the fastest response without deterioration of the control characteristic. As a result, the overshoot described in connection with FIG. 4 is not induced.

Figure 7:
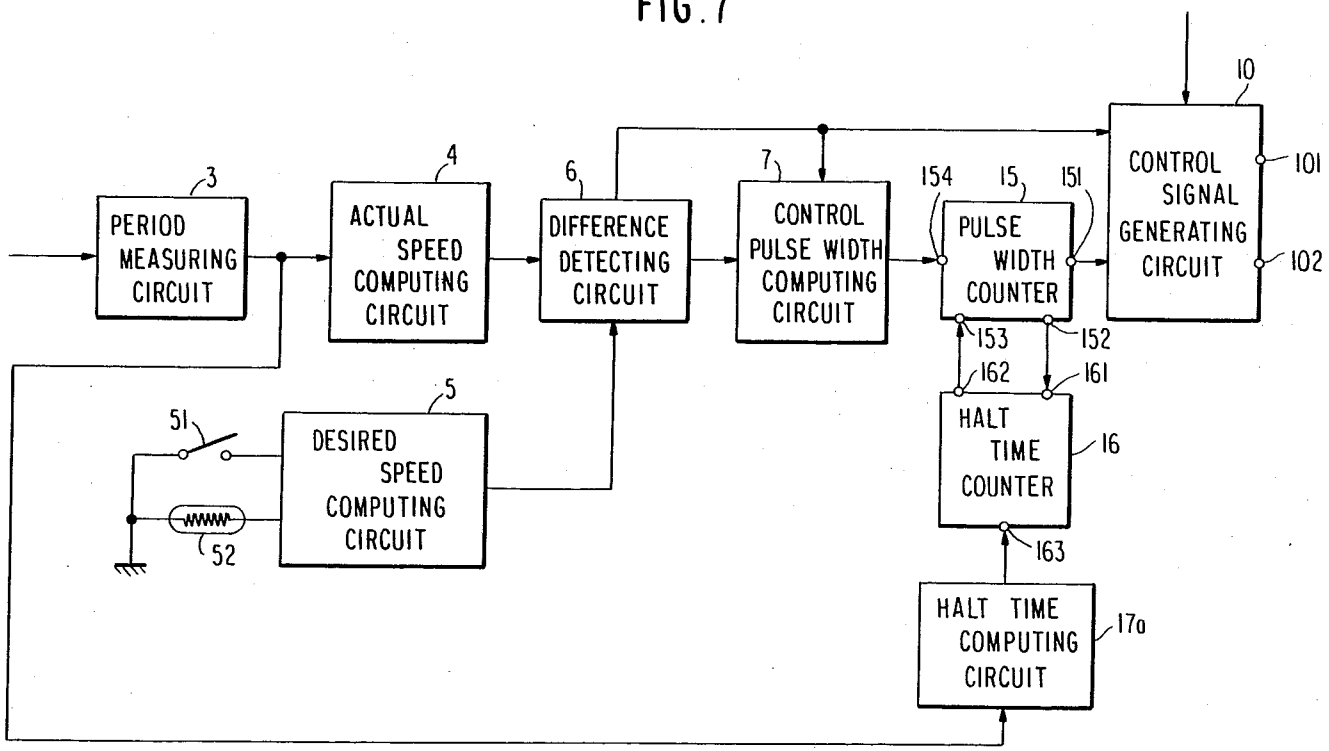
FIG. 7 is a block diagram of another embodiment of the invention.

FIG. 7 is a block diagram of another exemplary apparatus embodying this invention, wherein the driving halt time is established in accordance with an engine operation parameter so as to halt the actuator for a time length corresponding to the delay in the engine response time to an actuator driving signal. In this structure, even when the desired idling speed varies depending on a cooling water temperature or an engine load, an optimal driving halt time can be selected to ensure satisfactory response characteristic. In FIG. 7, there are shown a pulse width counter 15, output terminals 151 and 152, input terminals 153 and 154, a halt time counter 16, input terminals 161 and 163, an output terminal 162, and a halt time computing circuit 17*a* (seventh unit). Other components such as an ignition coil 1, an ignition coil controller 2, a driving circuit 11 and a throttle valve actuator 12 are the same as those shown previously in FIG. 1 and are therefore omitted in the diagram of FIG. 7.

Halt time computing circuit 17*a* receives the ignition interval data from period measuring circuit 3 and feeds halt time data, which has a value proportional to the ignition interval, to the input terminal 163 of halt time counter 16. Since the ignition interval is in inverse proportion to the engine speed while being in direct proportion to the delay in the engine response time, it is rendered possible to continuously obtain a minimal driving halt time regardless of the DC motor driving time or the engine speed by proportioning the halt time to the ignition interval and selecting the relationship of proportion therebetween in conformity with the engine capabilities. Thus, even when the desired rotational speed varies, a minimal halt time is obtainable in accordance with the actual engine speed at a certain moment, hence satisfying the requirements with regard to both the control and response characteristics.

Although the halt time computing circuit 17*a* in the above embodiment of FIG. 7 provides a driving halt time as a function of the ignition interval, some other factor may be utilized as well if it is a function of the engine speed. The data representing the delay in the engine response time is not limited to the engine speed alone. It is also possible to utilize the amount of intake air per unit time or the engine load determined by the engine speed and the manifold pressure, and the halt time may be given as a function thereof. Furthermore, the apparatus of this invention can be constituted with facility by the use of elements with computing capabilities such as microcomputer, input-output elements and timer elements. In addition to the above example so arranged as to control the actuator driving time due to the inclusion of the DC motor 121 therein, the same effect is attainable by adjusting the controlled variable thereof.

Industrial Usability

The present invention is applicable to control of general industrial machinery engines as well as to control of automobile engines.

What is claimed is:

1. An engine speed control apparatus comprising: an actuator for adjusting an engine speed; a first unit for computing a desired engine speed; a second unit for detecting the actual engine speed; a third unit for detecting the difference between the outputs of said first and second units; fourth unit for computing a control pulse width for said actuator in accordance with the output of said third unit; a fifth unit for generating a control signal; a sixth unit for driving said actuator in response to the output of said fifth unit; and a seventh unit for computing an optimal halt time to interrupt the driving of said actuator; wherein said actuator is driven intermittently in conformity in said control pulse width and said halt time.

2. The engine speed control apparatus as defined in claim 1, wherein said seventh unit computes an optimal halt time in accordance with said control pulse width.

3. The engine speed control apparatus as defined in claim 1, wherein said seventh unit computes an optimal halt time in accordance with an operation parameter representative of the delay in the engine response time.

4. The engine speed control apparatus as defined in claim 3, wherein the operation parameter representing the delay in the engine response time is the rotational speed of the engine.

5. The engine speed control apparatus as defined in claim 3, wherein the operation parameter representing the delay in the engine response time is the amount of intake air of the engine per unit time.

6. The engine speed control apparatus as defined in claim 3, wherein the operation parameter representing the delay in the engine response time is the engine load determined on the basis of the engine speed and the manifold pressure.

7. The engine speed control apparatus as defined in claim 4, wherein an ignition time interval is used as information relative to the engine speed.

8. An engine speed control apparatus comprising: an actuator for adjusting an engine speed; a circuit for computing a desired engine speed; a circuit for detecting the actual engine speed; a circuit for detecting the difference and the numerical relationship between the outputs of said desired engine speed computing circuit and said actual engine speed detecting circuit; a circuit for computing a control pulse width in accordance with the difference output of said difference detecting circuit; a pulse width counter for presetting the output of said control pulse width computing circuit, then executing subtractive count for a predetermined period of time and producing a pulse output representative of the driving time for said actuator; a circuit for computing an actuator halt time in accordance with the output of said control pulse width computing circuit; a halt time counter for presetting the output of said halt time computing circuit upon arrival of the counted value of said pulse width counter at zero, then executing subtractive count for a predetermined period of time, subsequently presetting said pulse width counter upon arrival of the counted value thereof at zero, and producing a pulse output representative of the halt time to interrupt the driving of said actuator; a circuit for generating a control signal in response to the output of said pulse width counter and the output of said difference detecting circuit; and a circuit for driving said actuator in conformity to the output of said control signal generating circuit.

* * * * *